US009067129B2

(12) United States Patent
Encina Cusi

(10) Patent No.: US 9,067,129 B2
(45) Date of Patent: Jun. 30, 2015

(54) CYLINDRICAL LABYRINTH

(71) Applicant: YTRES ASSEMBLY, S.L., Aretxabaleta (ES)

(72) Inventor: Oscar Encina Cusi, Aretxabaleta (ES)

(73) Assignee: YTRES ASSEMBLY, S.L., Aretxabaleta (ES)

( * ) Notice: Subject to any disclaimer, the term of this patent is extended or adjusted under 35 U.S.C. 154(b) by 0 days.

(21) Appl. No.: 14/247,992

(22) Filed: Apr. 8, 2014

(65) Prior Publication Data

US 2014/0306404 A1 Oct. 16, 2014

(30) Foreign Application Priority Data

Apr. 12, 2013 (ES) ..... 201330442 U

(51) Int. Cl.

*A63F 9/08* (2006.01)
*A63F 7/04* (2006.01)
*A63F 9/00* (2006.01)

(52) U.S. Cl.

CPC ..... *A63F 7/042* (2013.01); *A63F 9/0078* (2013.01); *A63F 9/083* (2013.01)

(58) Field of Classification Search

CPC ..... A63F 9/08; A63F 9/06; A63F 9/0078; A63F 9/0602; A63F 9/0826; A63F 9/0857; A63F 9/083; A63F 7/042

See application file for complete search history.

(56) References Cited

U.S. PATENT DOCUMENTS

| | | | | | |
|---|---|---|---|---|---|
| 3,819,187 | A | * | 6/1974 | Downs | 273/156 |
| 4,065,132 | A | * | 12/1977 | Giakas | 273/153 R |
| 4,376,537 | A | * | 3/1983 | Yokoi | 273/153 S |
| D274,074 | S | * | 5/1984 | Brunko | D21/478 |
| 4,509,753 | A | * | 4/1985 | Vaughan, Jr. | 273/110 |
| 4,657,255 | A | * | 4/1987 | Seres | 273/113 |
| 4,754,972 | A | * | 7/1988 | Boskovic | 273/113 |
| 4,822,047 | A | * | 4/1989 | Treer | 273/113 |
| 4,822,049 | A | * | 4/1989 | Biber | 273/110 |
| 5,123,650 | A | * | 6/1992 | Slauter | 273/155 |
| 5,281,039 | A | * | 1/1994 | Hsiung et al. | 401/195 |
| 5,292,126 | A | * | 3/1994 | Hanley | 273/153 S |
| 5,441,260 | A | * | 8/1995 | Gogarty | 273/153 R |
| 5,451,055 | A | * | 9/1995 | Lo | 273/153 S |
| 5,884,912 | A | * | 3/1999 | Ignatiev | 273/153 S |
| 6,139,015 | A | * | 10/2000 | Hsieh | 273/153 R |
| 2003/0015839 | A1 | * | 1/2003 | Ignatiev | 273/153 R |

OTHER PUBLICATIONS

Gemeenschapsmodel 002144584-0001; Spierenburgh; Dec. 2012; 3 pages.

Gabriel Fernandes' Puzzle Collection; Mazeroll; Jan. 2013; 5 pages.

Laboo Maze on Behance; Jan. 2013; 6 pages.

Search Report and Written Opinion issued in corresponding Netherland application No. 2012602 and English translation.

* cited by examiner

*Primary Examiner* — Steven Wong
(74) *Attorney, Agent, or Firm* — Lucas & Mercanti, LLP

(57) ABSTRACT

Cylindrical labyrinth that comprises a plurality of cylindrical bodies (10), where each one of them presents an outer wall (11) with a labyrinthine path (12) configured to be traversed by a ball (2) between an entry (13) into the labyrinthine path (12) and an exit (14) from the labyrinthine path (12); and a longitudinal shaft (20) configured to pierce and align the cylindrical bodies (10) and to allow the rotation thereof with respect to said shaft (20). Each cylindrical body (10) comprises a transparent cover (70) configured to cover the outer wall (11) of said body (10) and to prevent the ball (2) from falling out from the labyrinthine path (12) thereof.

11 Claims, 8 Drawing Sheets

CYLINDRICAL LABYRINTH

CROSS-REFERENCE TO RELATED APPLICATIONS

This application claims the priority of ES U201330442, filed Apr. 12, 2013, the entire content of the Application is incorporated herein by reference.

TECHNICAL FIELD

The present invention is encompassed within the field of games of skill, and more specifically, it relates to a cylindrical labyrinth designed to lead a ball between an entry point into a labyrinthine path and an exit point therefrom.

BACKGROUND ART

There are several labyrinth-type games of skill that are currently known, where the user must lead a ball between an entry point and an exit point through a labyrinthine path arranged between said points.

The most usual of these include two-dimensional labyrinths, or 2D labyrinths, which may adopt different shapes, the most usual of which being rectangular or circular. These labyrinths comprise a fixed labyrinthine path that does not admit any modifications from the user. Once the game is solved the first few times, users acquire the necessary knowledge to complete it successively as often as they wish in a mechanical and repetitive manner, losing with it interest in the game.

Three-dimensional labyrinths or 3D labyrinths, which mainly adopt a cylindrical shape, are much less frequent. These labyrinths comprise a dynamic labyrinthine path that can be modified by the user in order to face a different challenge every time he or she plays the game. They are generally formed by a plurality of cylindrical bodies and a longitudinal shaft, where said longitudinal shaft is configured to pierce and align the cylindrical bodies and to allow the rotation thereof with respect to said shaft. Each cylindrical body presents an outer wall with a labyrinthine path configured to be traversed by a ball between an entry into the labyrinthine path and an exit therefrom. The individualized rotation of each body allows the user to modify the route of the ball during the game between a starting point and an ending point thereof.

However, existing cylindrical labyrinths present important inconveniences that affect the correct operation thereof and that dull the game. In that sense, the labyrinthine path of each body is constituted by a channel engraved in the outer wall thereof, partially embracing the ball to prevent it from flying out of the labyrinth. These channels make it difficult for the user to correctly see the ball during the game, cause the ball to often get stuck in any section, especially those comprising straight angles, accumulate dirt and complicate the manufacturing of the labyrinth.

The cylindrical labyrinth of the present invention solves the aforementioned problems by providing a transparent cover for each cylindrical body, which allows having wider channels through which the ball is able to pass more smoothly without flying out from the labyrinth. In addition, the labyrinth of the present invention presents an improved structural configuration that facilitates the mounting and usage thereof by the user.

SUMMARY OF THE INVENTION

The cylindrical labyrinth of the present invention comprises:

a plurality of cylindrical bodies, where each one of them presents an outer wall with a labyrinthine path configured to be traversed by a ball between an entry into the labyrinthine path and an exit from the labyrinthine path; and a longitudinal shaft configured to pierce and align the cylindrical bodies and to allow the rotation thereof with respect to said shaft.

Said labyrinth is characterized in that each cylindrical body comprises a transparent cover configured to cover the outer wall of said body and to prevent the ball from falling out from the labyrinthine path thereof. This way, the channels of the labyrinthine path can be as wide as necessary in order for the ball to run smoothly. And therefore, the ball does not need to be partially embraced in order to prevent it from flying off, which reduces its mobility.

The interpretation of transparent extends to any type of material that allows seeing the ball through the same, in a more or less clear or even translucent manner.

Materials enabled for said purpose can be used to achieve the foregoing, which should preferably be plastic, tinted or non-tinted, partially covered with adhesives or any other type of decorative element that improves the aesthetic appearance of the labyrinth.

Preferably, the shaft comprises a first end that presents introducing and retaining means configured to facilitate the introduction of the shaft into the cylindrical bodies and to prevent the detachment thereof once pierced and aligned. The introducing and retaining means in turn comprise a truncated cone-shaped flange with a descending diameter according to the direction of introduction of the shaft into the cylindrical bodies, which works together with an axial empty space to facilitate said introduction and that presents a retaining wall configured to prevent the detachment of the shaft from the cylindrical bodies.

The cylindrical bodies can be mounted on the shaft in a direct or an indirect manner. According to an indirect mounting form, the labyrinth comprises an axial adapter configured to remain affixed to the interior of the cylindrical body and to be pierced by the shaft, allowing the rotation thereof. The axial adapter comprises an inner hollow cylinder presenting a through-hole configured to be pierced by the axis; a plurality of radial arms that present adaptation ends configured to fit in affixing slots arranged on an inner wall of the cylindrical body; and an intermediate hoop connected to said radial arms.

In order to prevent slacks between adjoining cylindrical bodies that could affect the correct development of the game, the labyrinth comprises a closing ring configured to be inserted in the shaft and to ensure an axial tightening on said cylindrical bodies. The closing ring comprises a V-shaped transversal tear that presents a corner aimed towards the interior of the closing ring and that extends along the length of an outer cylindrical sector thereof; and a protuberance in a frontal face of said closing ring in an angular position matching the larger opening of the transversal tear.

In turn, the shaft comprises a second end that presents auxiliary tightening means configured to work together with the closing ring and to favor the axial tightening on the cylindrical bodies. The auxiliary tightening means comprise a head configured to adjust the closing ring against, the cylindrical body.

In order to facilitate the mounting of the cover, the labyrinth preferably comprises connecting means between the cylindrical body and the cover configured to join the cover to the cylindrical body and to prevent a relative rotation between the same. The connecting means comprise a relief in the cover configured to be housed in a recess of the cylindrical body, where said recess is located between the outer wall and a frontal wall of the cylindrical body.

The labyrinth comprises a top that presents closing means configured to fit in the cylindrical body. Preferably, two tops are arranged, one at each end of the labyrinth, which independently constitute the starting point or the ending point of the game, given that the labyrinth is reversible and that the game can be played from either direction.

The top comprises a transparent closing cover that encloses a cavity configured to house the ball, through which said ball can enter and exit the labyrinthine path of the cylindrical body. The closing means comprise a plurality of tabs perpendicular to the closing wall, which ends present a truncated cone-shaped flange with a descending diameter according to the direction of introduction of the top into the cylindrical body, and which presents a fastening wall configured to prevent the detachment of the top from the cylindrical body. The fastening wall is configured to fit with the intermediate hoop of the axial adapter.

BRIEF DESCRIPTION OF THE DRAWINGS

A series of drawings, which facilitate the comprehension of the invention and are expressly related to an embodiment of said invention presented as a non-limitative example thereof, will be very briefly described below.

DETAILED SUMMARY OF THE INVENTION

Figure 1:
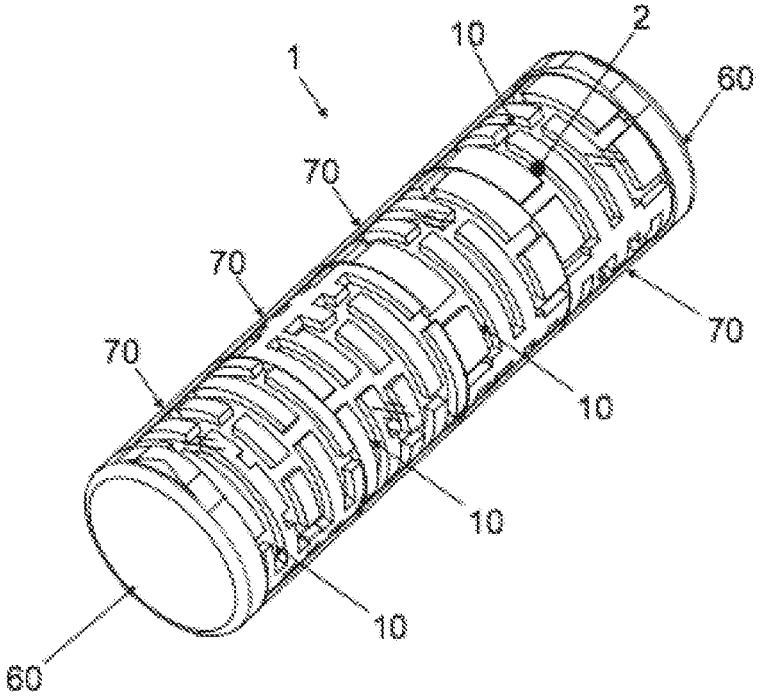
FIG. 1 represents a perspective view of the labyrinth of the present invention.
Figure 2:
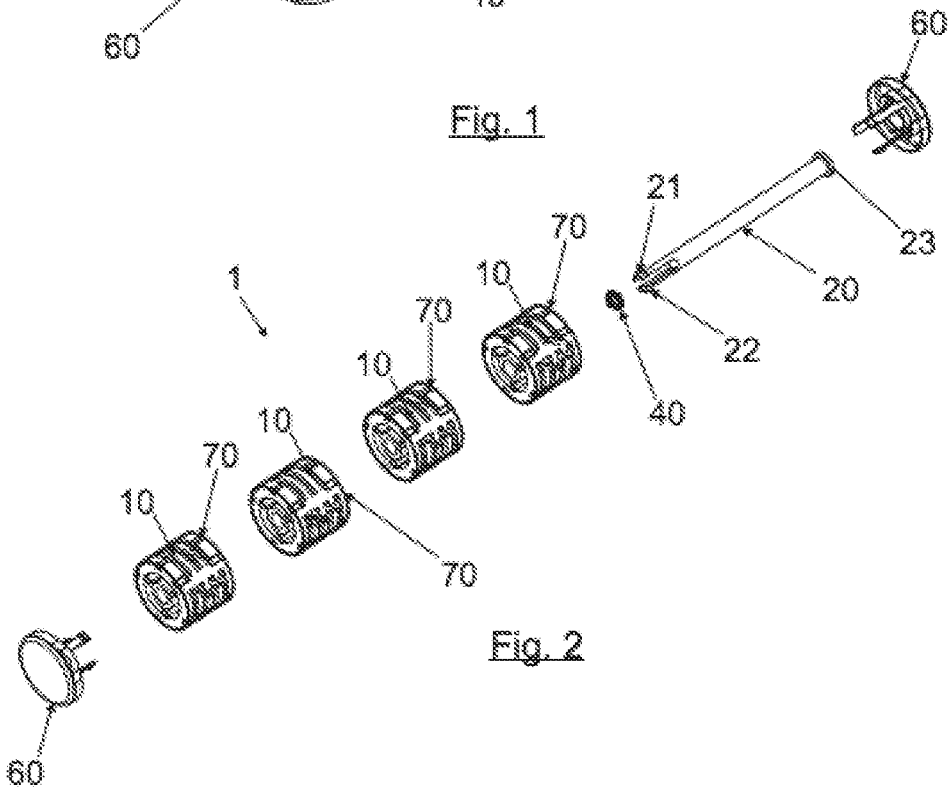
FIG. 2 represents an exploded perspective view of the labyrinth of the present invention.
Figure 3:
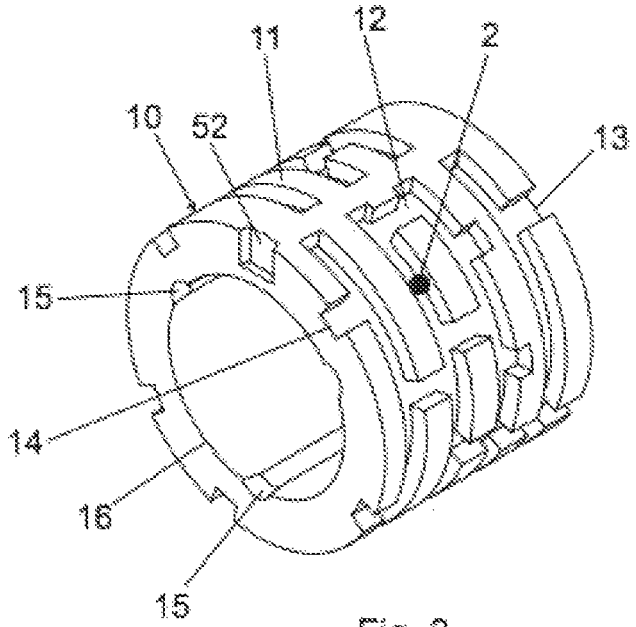
FIG. 3 represents a perspective view of a cylindrical body.

FIGS. 1 and 2 respectively show a perspective view and an exploded view of the labyrinth (1) of the present invention. As shown therein, the cylindrical labyrinth (1) comprises:

- a plurality of cylindrical bodies (10), four in the present example, where each one of them presents an outer wall (11) with a labyrinthine path (12) configured to be traversed by a ball (2) between an entry (13) into the labyrinthine path (12) and an exit (14) from the labyrinthine path (12), FIG. 3; and
- a longitudinal shaft (20) configured to pierce and align the cylindrical bodies (10) and to allow the rotation thereof with respect to said shaft (20).

Each cylindrical body (10) comprises a transparent cover (70) configured to cover the outer wall (11) of said body (10) and to prevent the ball (2) from falling out horn the labyrinthine path (12) thereof, allowing the user to see the ball (2) in order to play the game correctly at the same time.

FIG. 3 shows a perspective view where the cylindrical body (10) configuration can be observed in more detail. The labyrinthine path (12) can adopt any type of route, made with straight and/or curved lines, to make it more attractive and to adjust the difficulty thereof. The number of entries (13) and exits (14) can also be determined based on the desired difficulty. Given that the game is played in both directions, the entries (13) act as exits (14) and vice versa when the user returns the ball (2) to the starting point. The different cylindrical bodies (10) making tip the labyrinth can have different labyrinthine paths (12). In addition, the positions thereof can be exchanged with respect to the shaft (20) and can rotate 180°, the foregoing in order to have a greater number of different routes and to increase the interest in the game.

Figure 4A:
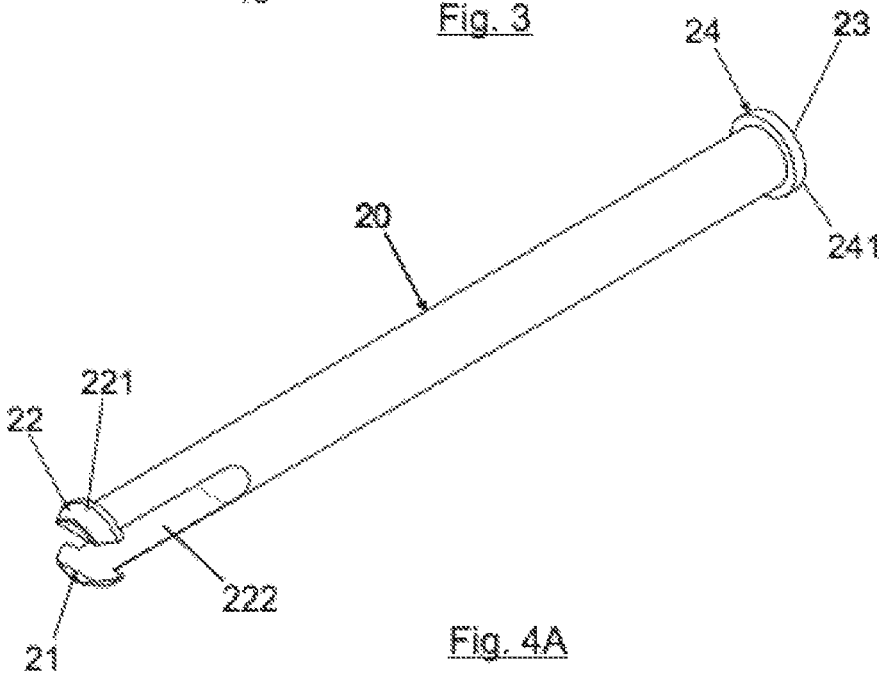
FIG. 4A represents a perspective view of the longitudinal shaft.
Figure 4B:
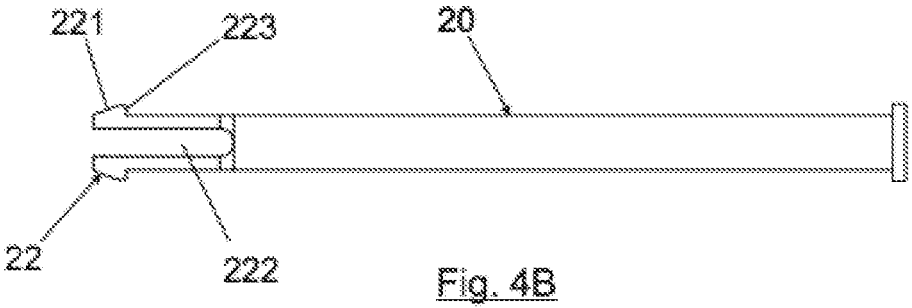
FIG. 4B represents a lateral view of the longitudinal shaft.

FIGS. 4A and 4B respectively show a perspective and a lateral view of the longitudinal shaft (20). As shown therein, the shaft (20) comprises a first end (21) that presents introducing and retaining means (22) configured to facilitate the introduction of the shaft (20) into the cylindrical bodies (10) and to prevent the detachment thereof once they have been pierced and aligned. The introducing and retaining means (22) in turn comprise a truncated cone-shaped flange (221) with a descending diameter according to the direction of introduction of the shall (20) into the cylindrical bodies (10), which works together with an axial empty space (222) to facilitate said introduction and that presents a retaining wall (223) configured to prevent the detachment of the shaft (20) from the cylindrical bodies (10).

Figure 5A:
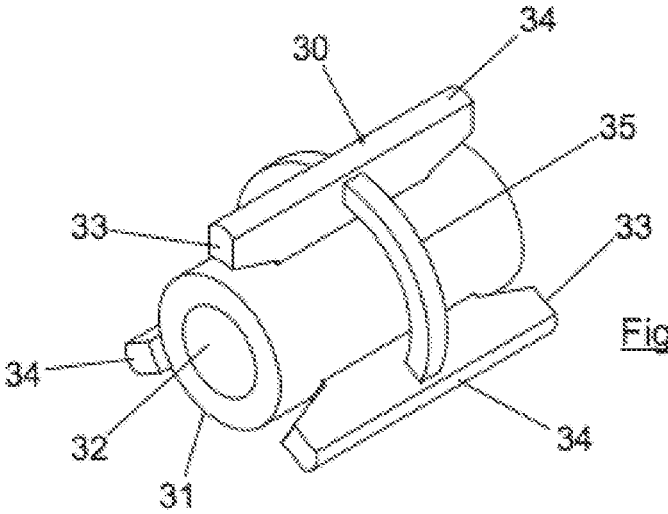
FIG. 5A represents a perspective view of an axial adapter.
Figure 5B:
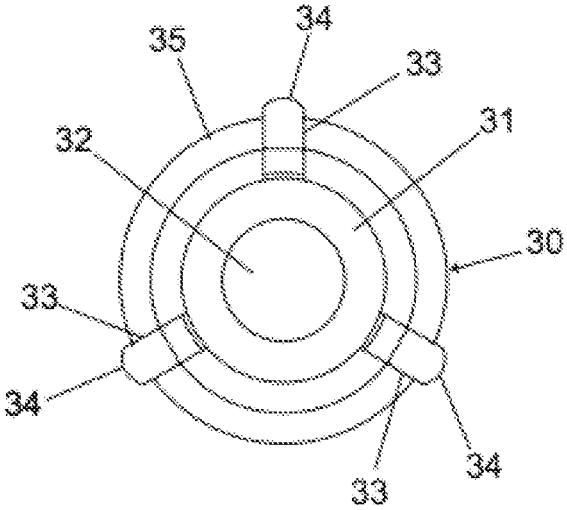
FIG. 5B represents a frontal view of an axial adapter.
Figure 6A:
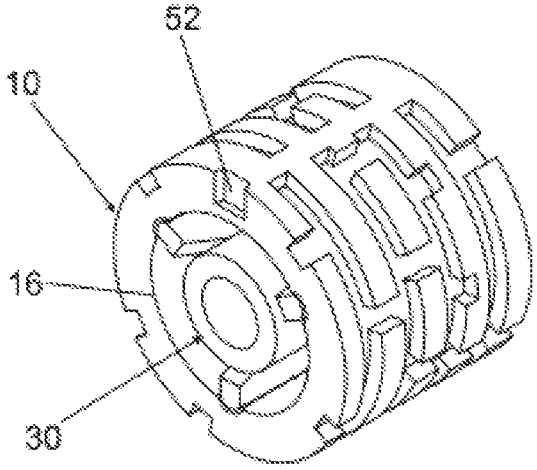
FIG. 6A represents a perspective view of an axial adapter mounted on a cylindrical body.
Figure 6B:
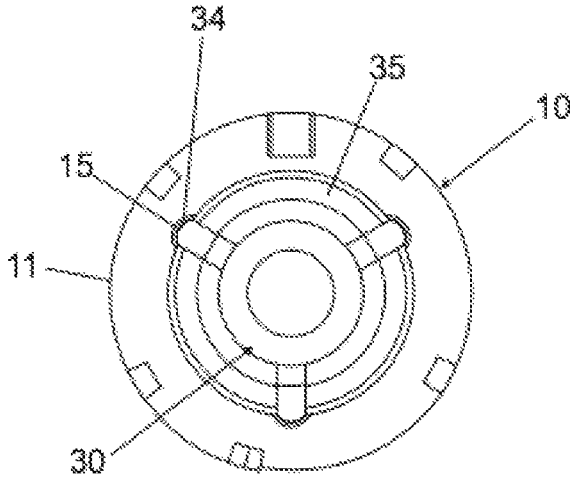
FIG. 6B represents a frontal view of an axial adapter mounted on a cylindrical body.

FIGS. 5A and 5B respectively show a perspective view and a frontal view of an axial adapter (30), while FIGS. 6A and 6B respectively show a perspective view and a frontal view of an axial adapter (30) mounted on a cylindrical body (10). As shown therein, the axial adapter (30) is configured to remain affixed to the interior of the cylindrical body (10) and to be pierced by the shaft (30), allowing the rotation thereof. The axial adapter (30) comprises an inner hollow cylinder (31) that presents a through-hole (32) configured to be pierced by the shaft (20); a plurality of radial arms (33) that present adaptation ends (34) configured to fit in affixing slots (15) arranged on an inner wall (16) of the cylindrical body (10); and an intermediate hoop (35) connected to said radial arms (33).

Figure 7A:
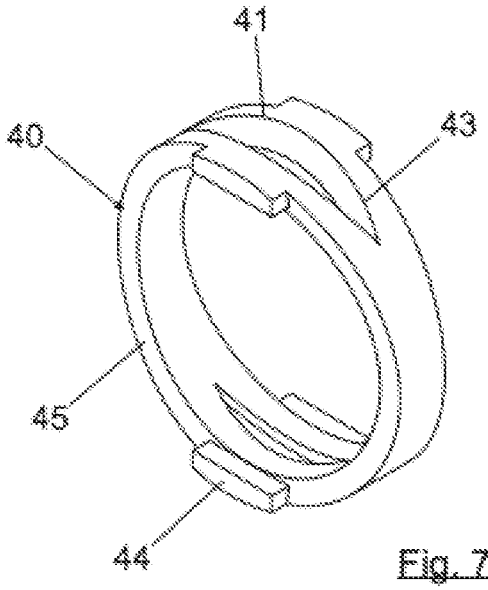
FIG. 7A represents a perspective view of the closing ring.
Figure 7B:
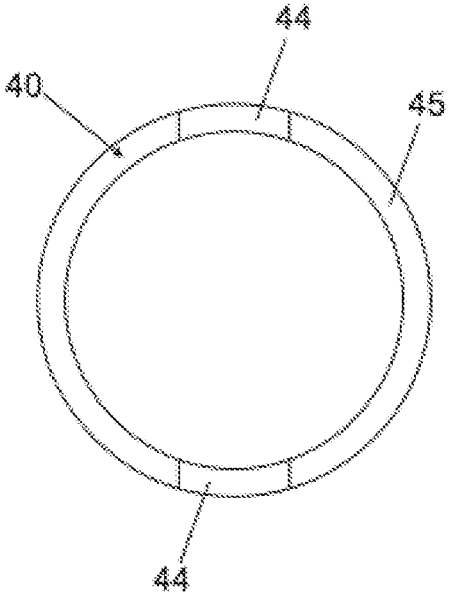
FIG. 7B represents a frontal view of the closing ring.
Figure 7C:
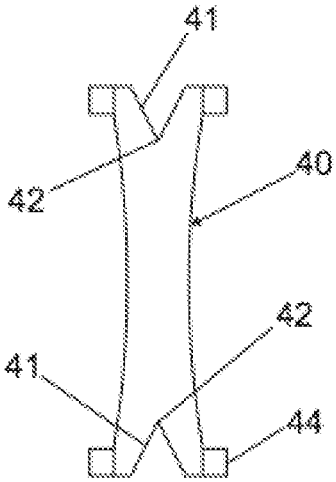
FIG. 7C represents a lateral view of the closing ring.

FIGS. 7A-7C respectively show a perspective view, a frontal view and a lateral view of the closing ring (40). As shown therein, the closing ring (40) is configured to be inserted in the shaft (30) and to ensure an axial tightening ($F_Z$) on said cylindrical bodies (10), FIG. 10. The closing ring (40) comprises two V-shaped transversal tears (41) presenting corners (42) aimed at the interior of the closing ring (40) and that extend along an end cylindrical sector (43) thereof; and protuberances (44) arranged in the frontal faces (45) of said closing ring (40) in an angular position matching the larger opening of the transversal tears (41).

Figure 10:
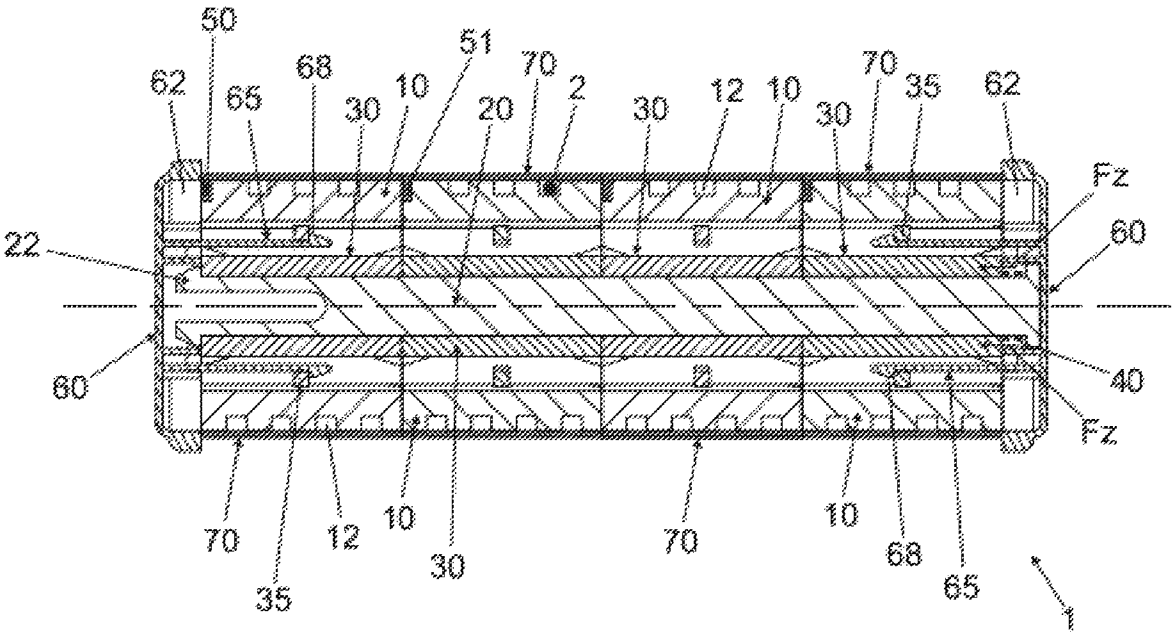
FIG. 10 represents a longitudinal section of the labyrinth.

In turn, the shaft (20) comprises a second end (23) that presents auxiliary tightening means (24) configured to work together with the closing ring (40) and to favor the axial tightening ($F_Z$) on the cylindrical bodies (10), FIGS. 4A and 10. The auxiliary tightening means (24) comprise a head (241) configured to adjust the closing ring (40) against the cylindrical body (10).

Figure 8A:
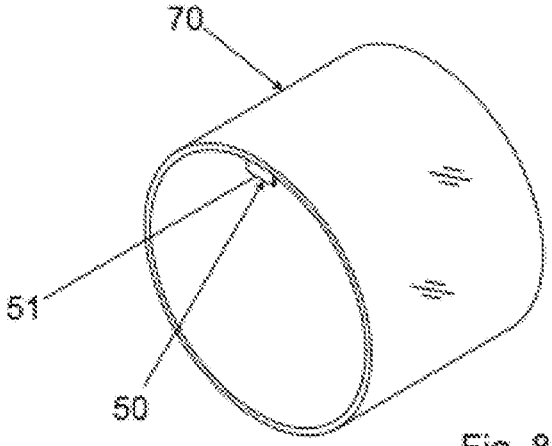
FIG. 8A represents a perspective view of a cover.
Figure 8B:
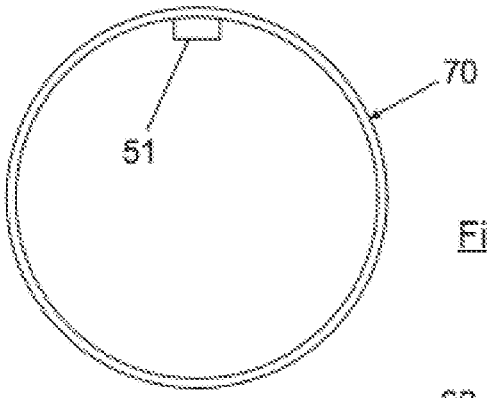
FIG. 8B represents a frontal view of a cover.
Figure 9A:
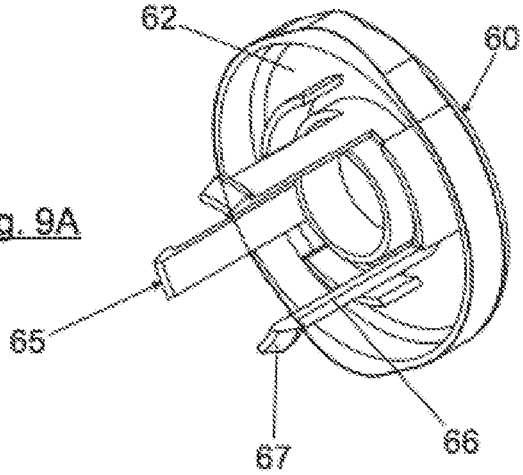
FIG. 9A represents a perspective view of the interior of a top.
Figure 9B:
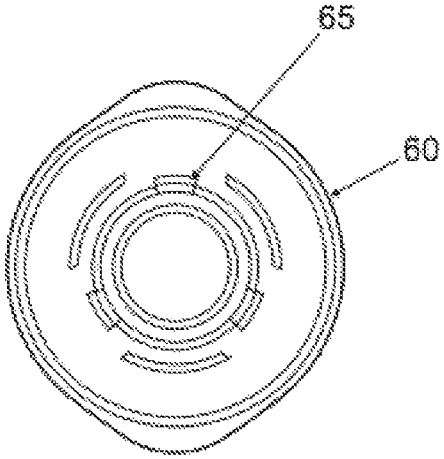
FIG. 9B represents a frontal view of the interior of a top.
Figure 9C:
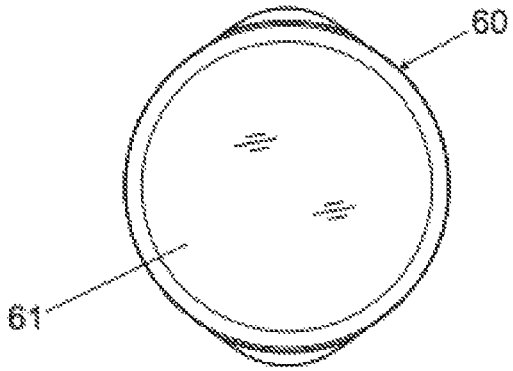
FIG. 9C represents a frontal view of the exterior of a top.
Figure 9D:
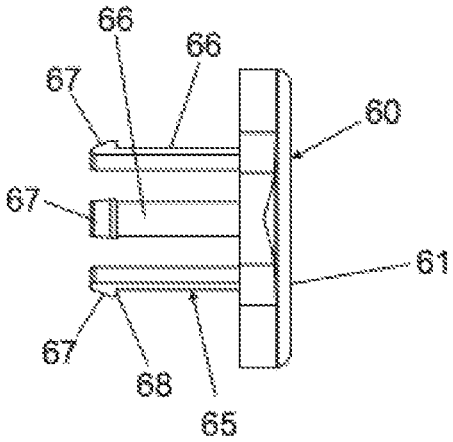
FIG. 9D represents a lateral view of a top.

FIGS. 8A and 8B respectively show a perspective view and a frontal view of a cover (70). In order to facilitate the mounting of the cover (70), the labyrinth (1) comprises connecting means (50) between the cylindrical body (10) and the cover (70) configured to join the cover (30) to the cylindrical body (10) and to prevent a relative rotation between the same. The connecting means (50) comprise a relief (51) in the cover (70) configured to be housed in a recess (52) of the cylindrical body (10), where said recess (52) is located between the outer wall (11) and a frontal wall (17) of the cylindrical body (10), FIG. 3.

FIGS. 9A-9D show different views of the top (60). As shown therein, the top (60) comprises closing means (65) configured to fit in the cylindrical body (10). The top (60) comprises a transparent closing cover (61) that encloses a cavity (62) configured to house the ball (2), through which said ball (2) can enter and exit the labyrinthine path (12) of the cylindrical body (10). The closing means (65) comprise a plurality of tabs (66) perpendicular to the closing wall (61), which ends present a truncated cone-shaped flange (67) with a descending diameter according to the direction of introduction of the top (60) into the cylindrical body (10), and which presents a fastening wall (68) configured to prevent the detachment of the top (60) from the cylindrical body (10). The fastening wall (68) is configured to fit with the intermediate hoop (35) of the axial adapter (30), FIG. 10.

FIG. 10 represents a longitudinal section of the labyrinth (1) showing the assembly of the entirety of the components thereof in greater detail.

The invention claimed is:

1. A cylindrical labyrinth comprising:

a plurality of cylindrical bodies, where each one of them presents an outer wall with a labyrinthine path configured to be traversed by a ball between an entry into the labyrinthine path and an exit from the labyrinthine path; and a longitudinal shaft configured to pierce and align the cylindrical bodies and to allow the rotation thereof with respect to said shaft;

wherein each cylindrical body comprises a transparent cover configured to cover the outer wall of said body and to prevent the ball from falling out from the labyrinthine path thereof, wherein an axial adapter is configured to remain affixed to the interior of the cylindrical body and to be pierced by the shaft, allowing the rotation thereof, and wherein the axial adapter comprises an inner hollow cylinder that presents a through-hole configured to be pierced by the shaft; a plurality of radial arms that present adaptation ends configured to fit in affixing slots arranged on an inner wall of the cylindrical body; and an intermediate hoop connected to said radial arms.

2. Cylindrical labyrinth according to claim 1, wherein the shaft comprises a first end that presents introducing and retaining means configured to facilitate the introduction of the shaft into the cylindrical bodies and to prevent the detachment thereof once they have been pierced and aligned.

3. Cylindrical labyrinth according to claim 2, wherein the introducing and retaining means comprise a truncated cone-shaped flange with a descending diameter according to the direction of introduction of the shaft into the cylindrical bodies, which works together with an axial empty space to facilitate said introduction and that presents a retaining wall configured to prevent the detachment of the shaft from the cylindrical bodies.

4. A cylindrical labyrinth comprising:

a plurality of cylindrical bodies, where each one of them presents an outer wall with a labyrinthine path configured to be traversed by a ball between an entry into the labyrinthine path and an exit from the labyrinthine path;

a longitudinal shaft configured to pierce and align the cylindrical bodies and to allow the rotation thereof with respect to said shaft; and a closing ring configured to be inserted in the shaft and to ensure an axial tightening ($F_Z$) on said cylindrical bodies, wherein each cylindrical body comprises a transparent cover configured to cover the outer wall of said body and to prevent the ball from falling out from the labyrinthine path thereof, and wherein the closing ring comprises a V-shaped transversal tear that presents a corner aimed at the interior of the closing ring and that extends along an end cylindrical sector thereof; and a protuberance arranged in a frontal face of said closing ring in an angular position matching the larger opening of the transversal tear.

5. Cylindrical labyrinth according to claim 4, wherein the shaft comprises a second end that presents auxiliary tightening means configured to work together with the closing ring and to favor the axial tightening ($F_Z$) on the cylindrical bodies.

6. Cylindrical labyrinth according to claim 5, wherein the auxiliary tightening means comprise a head configured to adjust the closing ring against the cylindrical body.

7. A cylindrical labyrinth comprising:

a plurality of cylindrical bodies, where each one of them presents an outer wall with a labyrinthine path configured to be traversed by a ball between an entry into the labyrinthine path and an exit from the labyrinthine path; and a longitudinal shaft configured to pierce and align the cylindrical bodies and to allow the rotation thereof with respect to said shaft;

wherein each cylindrical body comprises a transparent cover configured to cover the outer wall of said body and to prevent the ball from falling out from the labyrinthine path thereof, wherein connecting means between the cylindrical body and the cover is configured to join the cover to the cylindrical body and to prevent a relative rotation between the same, and wherein the connecting means comprise a relief in the cover configured to be housed in a recess of the cylindrical body, where said recess is located between the outer wall and a frontal wall of the cylindrical body.

8. Cylindrical labyrinth according to claim 1, wherein a top that presents closing means is configured to fit in the cylindrical body.

9. Cylindrical labyrinth according to claim 8, wherein the top comprises a transparent closing cover that encloses a cavity configured to house the ball, through which said ball can enter and exit the labyrinthine path of the cylindrical body.

10. Cylindrical labyrinth according to claim 9, wherein the closing means comprise a plurality of tabs perpendicular to a closing wall, which ends present a truncated cone-shaped flange with a descending diameter according to the direction of introduction of the top into the cylindrical body, and which presents a fastening wall configured to prevent the detachment of the top from the cylindrical body.

11. Cylindrical labyrinth according to claim 10, wherein the fastening wall is configured to fit with an intermediate hoop of the axial adapter.

* * * * *